US007550662B2

(12) United States Patent
Bonnat

(10) Patent No.: US 7,550,662 B2
(45) Date of Patent: Jun. 23, 2009

(54) MUSICAL INSTRUMENT WITH FREE REEDS

(76) Inventor: Pierre Bonnat, "Le Carron", 01290 Grieges (FR)

( * ) Notice: Subject to any disclaimer, the term of this patent is extended or adjusted under 35 U.S.C. 154(b) by 742 days.

(21) Appl. No.: 10/496,965

(22) PCT Filed: Nov. 27, 2002

(86) PCT No.: PCT/FR02/04075

§ 371 (c)(1),
(2), (4) Date: Mar. 4, 2005

(87) PCT Pub. No.: WO03/046883

PCT Pub. Date: Jun. 5, 2003

(65) Prior Publication Data

US 2005/0126367 A1 Jun. 16, 2005

(30) Foreign Application Priority Data

Nov. 27, 2001 (FR) ..... 01 15321

(51) Int. Cl.
*G10D 7/00* (2006.01)

(52) U.S. Cl. ..... 84/330

(58) Field of Classification Search ..... 84/330, 84/380 A, 375, 376 R, 376 A, 380 R
See application file for complete search history.

(56) References Cited

U.S. PATENT DOCUMENTS

| | | | | |
|---|---|---|---|---|
| 3,145,609 | A * | 8/1964 | Santini | 84/376 R |
| 3,776,089 | A * | 12/1973 | Cohen | 84/376 R |
| 4,196,650 | A | 4/1980 | Fricke et al. | |

FOREIGN PATENT DOCUMENTS

| | | |
|---|---|---|
| FR | 2658941 | 8/1991 |
| NL | 1007166 | 9/1997 |

* cited by examiner

*Primary Examiner*—Kimberly R Lockett

(57) ABSTRACT

The invention relates to a musical instrument having free reeds set into vibration by a flow of air generated by a supply (17) and capable of flowing from the supply in two directions referred to respectively as in and out, the instrument comprising: at least two boxes (2, 3) that are movable relative to each other by moving towards each other or apart from each other; a series of free reeds (27) mounted inside said boxes; and a valve actuator mechanism (31) where opening and closing the valves enables the reeds to be engaged or not engaged by the flow of air, the mechanism including in particular actuator keys (11) mounted on the moving boxes. The instrument of the invention includes means (5) for supporting and guiding displacement of the boxes relative to each other along a determined trajectory.

19 Claims, 3 Drawing Sheets

FIG.3
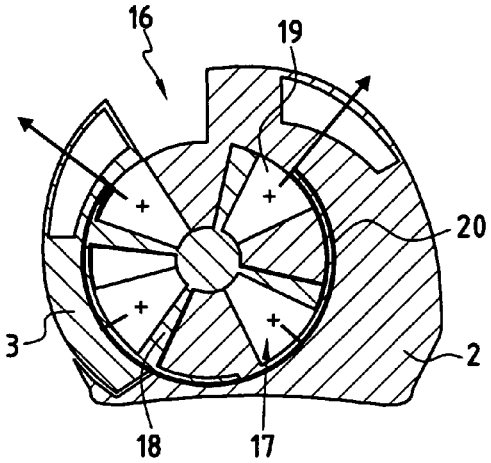
FIG.4
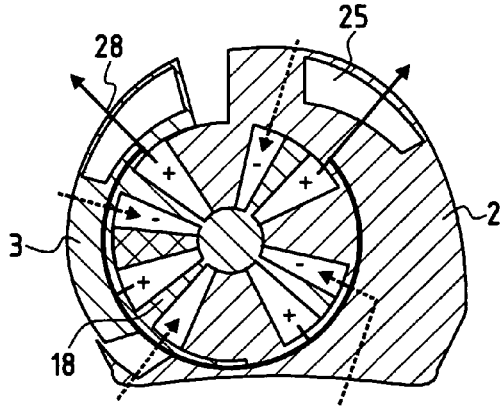
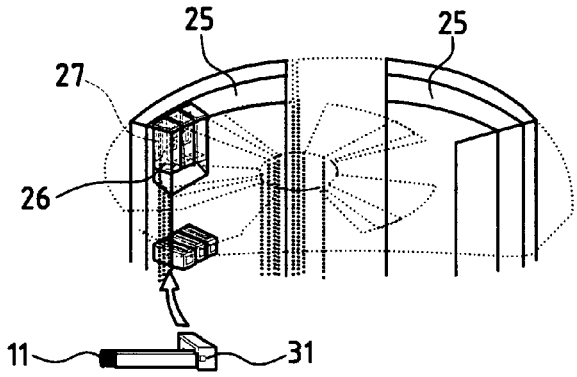
FIG.5
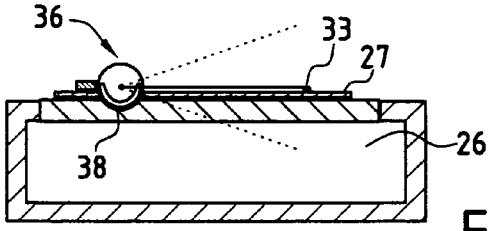
FIG.8
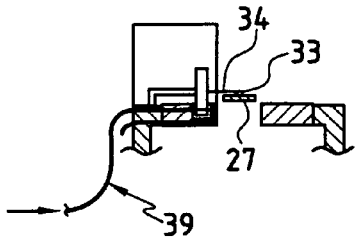
FIG.9
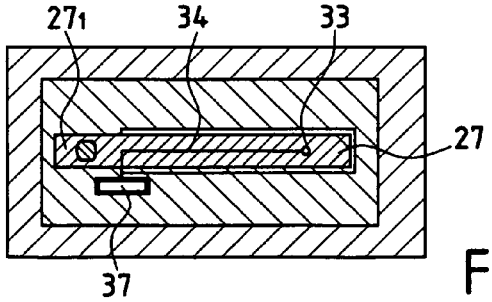
FIG.7

MUSICAL INSTRUMENT WITH FREE REEDS

FIELD OF THE INVENTION

The present invention relates to the technical field of wind instruments of the kind having "free" reeds, such as, for example: accordions; bandoneons; concertinas; bayans; etc.

BACKGROUND OF THE INVENTION

In the state of the art, this type of instrument comprises at least two boxes movable relative to each other by being moved towards each other or away from each other by the player. Generally, the boxes are interconnected by a bellows defining an air supply that is of variable capacity and that is in communication with a series of cells formed in boards carried by the boxes. Each cell is provided with two free reeds that are caused to vibrate by the inward or outward flow of air corresponding to the bellows being filled or emptied.

The cells are fitted with valves which, on being opened and closed, determine whether or not the reeds are engaged by the flow of air. The valves are controlled by a mechanism including in particular keys mounted on the boxes to be actuated by the player.

In conventional manner, the box for the right hand remains stationary, being supported by straps, while the box for the left hand moves to expand or to squeeze the bellows. It should also be observed that the musician must carry the weight of the box in the left hand, while simultaneously seeking to perform the part of the music that is for the left hand.

BRIEF SUMMARY OF THE INVENTION

The invention thus seeks to remedy the drawbacks of free reed musical instruments in the state of the art by proposing an instrument that makes playing considerably more comfortable, in particular for the left hand.

The invention thus seeks to achieve this object by proposing a musical instrument having free reeds set into vibration by a flow of air generated by an air supply and capable of flowing from the supply in two directions referred to respectively as in and out, the instrument comprising:

- at least two boxes that are movable relative to each other by moving towards each other or apart from each other;
- a series of free reeds mounted inside said boxes; and
- a valve actuator mechanism, where opening and closing the valves enables the reeds to be engaged or not engaged by the flow of air, the mechanism including in particular actuator keys mounted on the moving boxes.

In accordance with the invention, the instrument includes support and guide means for supporting and guiding displacement of the boxes relative to each other along a determined trajectory.

In the state of the art, it has also been found that problems of discontinuity in sound result from the movements of the bellows. In addition, in order to prolong a note or a chord, the musician must continue to move the bellows in a single direction to arms length.

Another object of the invention is to remedy the above-mentioned drawbacks by proposing a musical instrument in which the air supply is of fixed capacity and in which at least one moving member for compressing air can be moved, with the movement thereof being controlled by the moving box.

According to an advantageous characteristic of the invention, the flow of air leaving the air supply travels in a single direction, thus making it possible to use a single reed for the same note.

Another object of the invention is to propose a musical instrument including an electronic transducer system providing an improvement in sensitivity and precision in transducing sound, while being relatively insensitive to sound disturbances from the environment.

To achieve such an object the instrument of the invention includes, for each reed, a feeler that is in permanent contact with the reed, being constrained in rotation with a transducer for converting pivoting movement into an electrical signal.

Various other characteristics appear from the following description made with reference to the accompanying drawings which show, as non-limiting examples, embodiments and implementations of the invention.

BRIEF DESCRIPTION OF THE DRAWINGS

FIGS. 3 and 4 are cross-section views showing two characteristic operating positions of the instrument of the invention as shown in FIGS. 1 and 2.

FIG. 5 is a fragmentary view showing a characteristic detail of the instrument shown in FIGS. 1 to 4.

FIG. 7 is a plan view showing a characteristic detail of the invention.

FIGS. 8 and 9 are respectively an end view and a side view of FIG. 7.

DETAILED DESCRIPTION OF THE INVENTION

Figure 1:
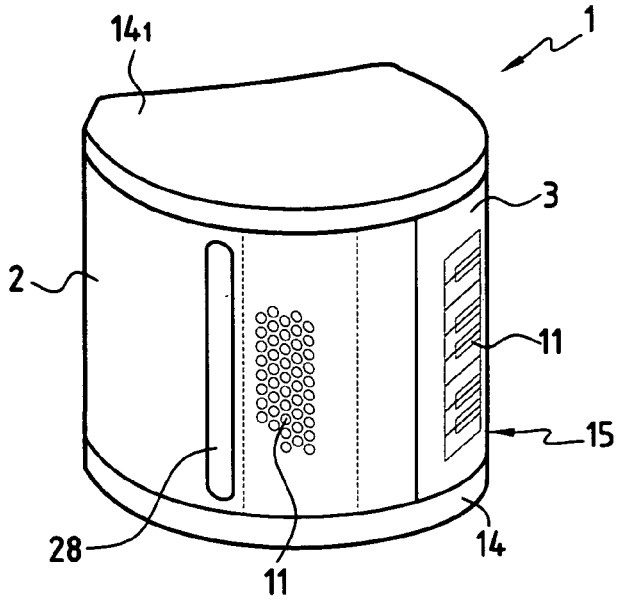
FIG. 1 is a fragmentary perspective view showing a first embodiment of a musical instrument in accordance with the invention.

As can be seen more clearly from FIGS. 1 to 5, the invention relates to a novel musical instrument given overall reference 1. In this embodiment as shown in FIGS. 1 to 5, the musical instrument 1 comprises a "fixed" first box 2 and a "moving" second box 3.

In accordance with the invention, the instrument 1 includes support and guide means 5 for supporting and guiding relative displacement between the boxes 2, 3 along a determined trajectory. In the example shown, the support and guide means 5 enable the boxes 2, 3 to move about a pivot axis 6 so that the trajectory or path followed by the moving box constitutes a circular segment. In the example shown, the "right-hand" or fixed box 2 serves to govern movement of the "left-hand" or moving box 3. In other words, it should be understood that the weight of the moving box 3 is supported by the fixed box 2 so that the left hand does not need to deliver any effort to support the box, but delivers effort solely for moving the moving box 3, as explained below. Playing comfort for the musician is considerably improved by the assisted movement and reduced stroke of the moving hand.

Figure 2:
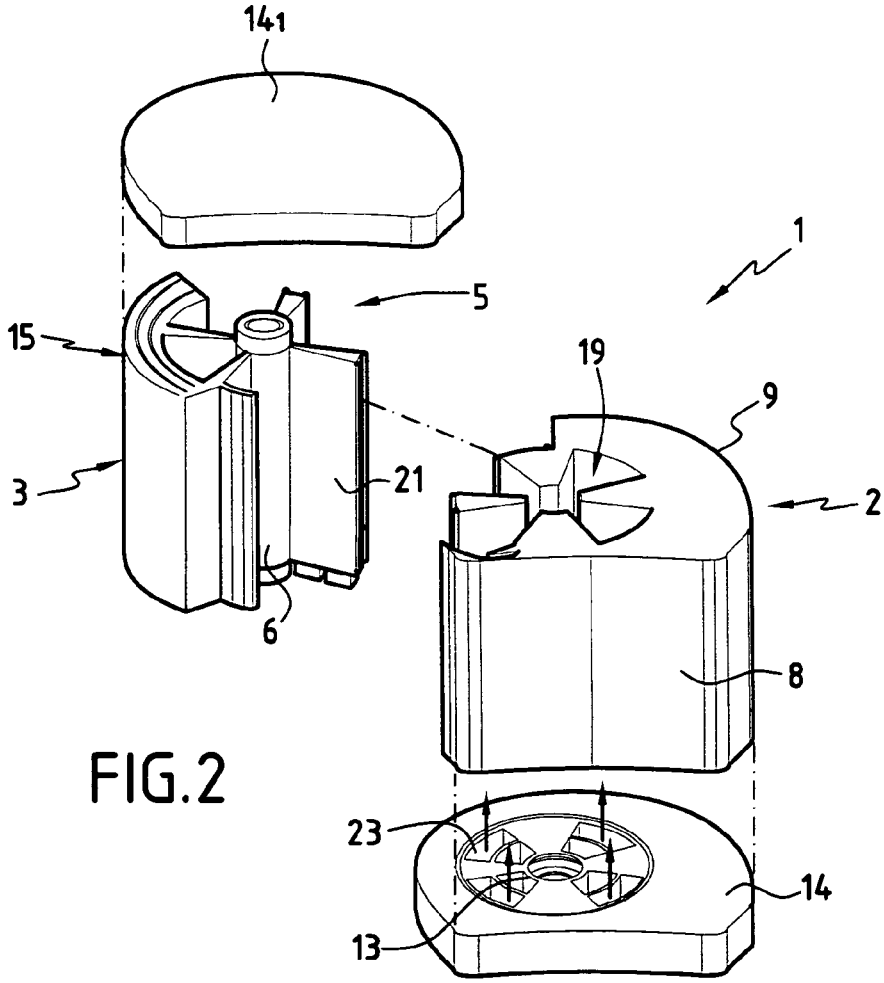
FIG. 2 is an exploded perspective view showing the apparatus of FIG. 1.

As can be seen more precisely in FIG. 2, the fixed box 2 possesses a preferably concave back 8 for fitting round the chest of the musician. The back 8 is extended from one side over substantially 90° by a rounded outer wall 9, having actuator keys 11 implanted therein, which keys may be made in any suitable manner, i.e. buttons, piano keys, pads, etc.

The fixed box 2 is arranged to enable the moving box 3 to be partially received therein, which moving box 3 is fitted with the pivot shaft 6 which is guided in pivoting at each of its end by bearings 13 provided in a bottom closure plate 14 and a top closure plate $\mathbf{14}_1$ that are mounted on the fixed box 2. In the example shown, the closure plates 14, $\mathbf{14}_1$ are fitted to the fixed box 2 so as to form parts thereof, however it is clear that the closure plates 14, $\mathbf{14}_1$ could be constituted as integral portions of the fixed box 2.

The moving box 3 has a rounded outside wall 15 which also has actuator keys 11 implanted on the front thereof. The moving box 3 is dimensioned so as to enable it to turn relative to the fixed box 2 over a stroke of ⅛th of a turn, for example. As can be seen clearly in FIGS. 3 and 4, the moving box 3 thus leaves an empty space 16 relative to the fixed box, thereby defining its stroke, which empty space 16 may optionally be fitted with a dummy bellows.

At its edge, the moving box 3 preferably includes rolling bearing and sealing means that co-operate with the bottom and top plates 14 and $\mathbf{14}_1$. According to another characteristic of the invention, the musical instrument 1 includes means (not shown) for delivering a force opposing the movement of bringing the boxes 2, 3 together, so as to comply with the musician's playing habits. This opposing force may naturally be adjustable, or even disconnectable, and it can be implemented by any appropriate means, such as a spring, a pneumatic system, or even a hydraulic system.

The instrument 1 is also preferably fitted with means for delivering a force urging the boxes 2, 3 apart while they are being moved apart. These means for delivering a force that urges the boxes apart make it easier to return the moving box 3 from its front position to its rear position. Implementing such means, alone or in combination with the means for delivering an opposing force, can avoid any need to use a strap on the left hand.

According to another preferred embodiment characteristic, at least the moving box 3 is fitted, close to the zone where the actuators keys are implanted, with zones against which the thumb or the palm of the hand can bear, making it easy to control the resistance delivered by the opposing means and/or the separating means, while still leaving the fingers free to actuate the keys 11.

According to another advantageous characteristic of the invention, the instrument 1 includes an air supply 17 of fixed capacity, within which there moves at least one moving compression member 3. In an embodiment, the fixed box 2 is arranged to define individual internal chambers 19, there being four in the example shown, which are closed in part and in airtight manner by the moving box 3 and by the bottom and top plates 14 and $\mathbf{14}_1$. The individual chambers 19 communicate with one another via a circuit 20 shown diagrammatically and constituting the supply 17 of fixed capacity. As its compression member, the moving box 3 is fitted with arms 21 that project from the pivot shaft 6 inside each of the individual chambers 19. According to a preferred embodiment characteristic, at least one end-of-stroke abutment is provided between the boxes 2 and 3 so as to ensure that the boxes themselves do not make contact with each other, thereby avoiding a sticking phenomenon when changing the travel direction of the moving box.

The musical instrument 1 also includes air inlets 23 arranged in the example shown through the bottom plate 14 and opening out into the individual chambers 19. The air inlets 23 are fitted with regulator means (not shown) such as valves so as to ensure that air flows through them only into the supply 17. Thus, the air present in the supply 17 cannot escape through the inlets 23.

The air supply 17 delivers air via at least one, and in the example shown two, outlets 24 to two boards 25 each mounted in a respective one of the boxes 2, 3 and each arranged to include a series of cells 26 each fitted with at least one free reed 27 for being engaged by the flow of air leaving the supply 17. The cells 26 which may be positioned in any suitable manner as shown in FIG. 5 communicate firstly, on their downstream sides, with air outlets 24 fitted with regulator means (not shown) ensuring that air flows only outwards from the supply 17 towards the cells 26, and secondly, on their upstream sides, with holes 28 allowing air to escape to the outside of the instrument. In other words, air going to the cells 26 can enter only via the air outlets 24. According to a preferred embodiment characteristic, the escape holes 28 are provided in a rounded portion of the walls of the boxes 2, 3 so as to enable sound to be well delivered and distributed to the outside environment. These escape holes 28 may be fitted with sound-diffusing flaps, in particular moving flaps, for example flaps whose movement is governed by the general movement of the instrument in order to project sound in a direction that is constant.

As can be seen from the above description, the instrument 1 includes means for channeling the air flow, which means are adapted to ensure that the flow for engaging the reeds 27 always travels past the reeds in the same direction, independently of the direction in which the flow travels from the supply 17, i.e. compression or suction.

Figure 6:
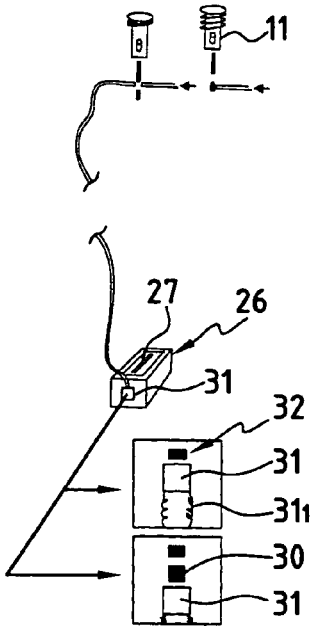
FIG. 6 is a diagram showing another embodiment of the mechanism for actuating the reed valves.

In conventional manner, each cell 26 is provided with a passage 30 fitted with a valve 31, which on being opened and closed serves to determine whether the reeds 27 are engaged or not engaged by the flow of air. The valves 31 are controlled by an actuator mechanism including the actuator keys 11. The actuator keys 11 control the displacement of the valves 31 in any appropriate manner. In a preferred variant embodiment as shown in FIG. 6, each valve 31 is caused to move by an electromagnet 32 controlled by a converter for converting light energy into electrical energy. The light energy is conveyed by an optical fiber that forms part of the actuator mechanism, and having on the path thereof an element for regulating light energy under the control of a key 11. The electromagnet moves the valve 31, which is preferably biased into position by a spring $\mathbf{31}_1$. In another embodiment, each valve 31 may be constituted by a piezoelectric diaphragm controlled by a converter for converting light energy into electrical energy.

According to an advantageous embodiment characteristic, as shown in FIGS. 7 to 9, each reed 27 is fitted with a feeler 33 mounted to make continuous contact with the reed. The feeler 33 is preferably made of plastics material, being extremely light in weight, and possibly having a pad of damper material at its point of contact with the reed, while delivering negligible resistance to vibration of the reed as transmitted by the flow of air. The feeler 33 is preferably in contact with the free end of the reed 27, i.e. its end remote from its fixed end $\mathbf{27}_1$. In the example shown, the feeler 33 is carried by a lever 34 that is constrained to turn with an optical type transducer 36. The transducer 36 comprise a rotary disk 37 constrained to turn with the lever 34, and that is urged resiliently by a spring to maintain permanent contact between the feeler 33 and the reed. The rotary disk 37 is fitted with an optical element 38 suitable for concentrating, decomposing, diffracting, reflecting, or diverting light radiation that is delivered and picked up by optical fibers 39. The beams that are picked up are used by a processor circuit (not shown) making it possible to determine the vibratory movement of the free reeds 27 with precision. The optical transducer 36 of the invention which converts the optical signals into electrical signals serves to translate the acoustic characteristics of the instrument faithfully. It should be observed that the transducer 36 for transducing the vibratory movement of the reeds could be of the electromagnetic type.

In the variant embodiment described above, in which each reed 27 is associated with a transducer, provision can be made for the reeds to be made out of any type of material, such as a plastics material, selected as a function of capacity to vibrate, and not on acoustic grounds. Under such circumstances, it should be understood that the free reeds 27 correspond to sound reeds or vibrating blades. The reeds 27 can be distributed at will within the instrument on supports that can be considered, by way of analogy, as being boards.

In a variant embodiment to which the valves 31 are controlled by means of a light energy converter, the optical fibers for conveying the light energy may be used to bring light energy to the optical transducers 36. In this variant, the actuator keys 11 at rest prevent light energy from passing, and when actuated they allow light energy to pass, e.g. in progressively increasing quantity. This results in savings in terms of the dimensioning of the power supply for the instrument.

In another variant embodiment, the circuit for processing the signals transmitted by the transducer 36 may include means for replicating the wave that is generated, insofar as the feeler 33 is liable to lose contact with the reed, under certain circumstances of rough and irregular operation. Such signal replication means are capable of partially reconstituting the spoilt waveform, during the extremely short period of time the feeler 33 and the associated reed 27 are no longer in contact.

In the embodiment described above, the musical instrument 1 presents the advantage of reducing the moving mass for the left hand. Naturally, means could be envisaged for supporting and guiding the displacement of the moving box along trajectories that are other than in rotation, for example that are linear, optionally combined with rotation, and that are directed from left to right or from bottom to top. Similarly, the instrument may be made with a fixed box having two moving boxes supported and guided in displacement relative thereto along determined trajectories.

In order to improve the playing comfort for the musician, the actuator keys 11 may be movably mounted, steerable, or even servo-controlled to the movement of the moving box, in particular to maintain a constant angle for the player's wrist.

In the embodiment shown, the moving member 18 for compressing air is constituted by moving arms that move inside individual chambers 19. Naturally, provision can be made to use other embodiments of moving compression members 18, such as, for example, disks, flaps, or pistons, having the pivoting and/or translation motion of the moving box delivered thereto by transmission means, e.g. of the cam, connecting rod, wormscrew, pinion gearing, etc. type.

Figure 10:
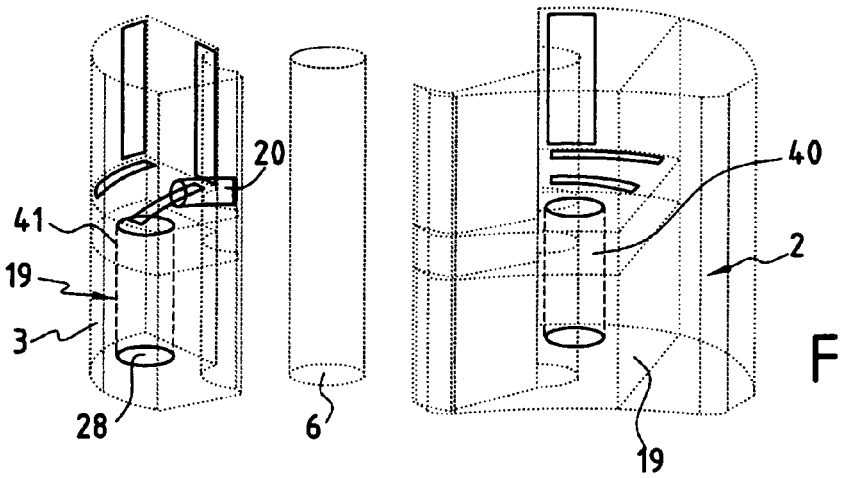
FIG. 10 is an exploded perspective view showing another embodiment of an instrument in accordance with the invention.
Figure 11:
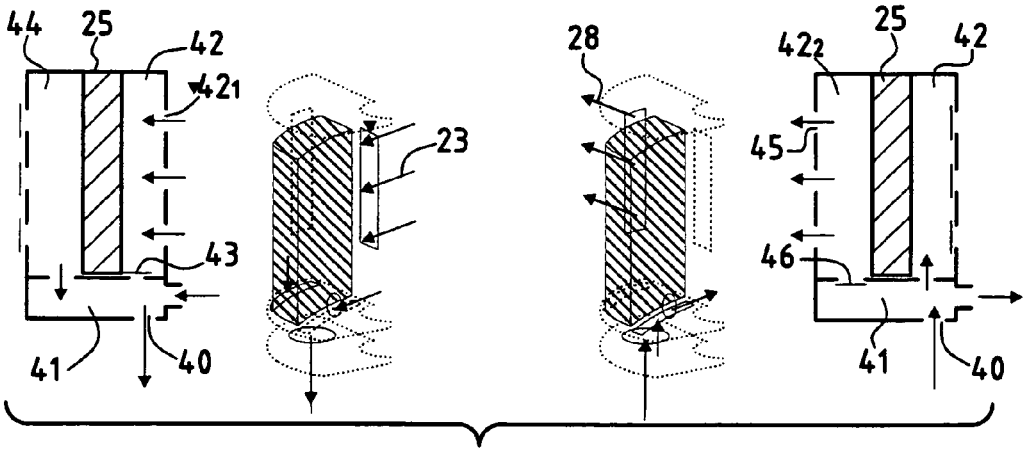
FIG. 11 is a view showing a characteristic detail of the variant embodiment shown in FIG. 10.

FIGS. 10 and 11 show another variant embodiment of a musical instrument 1. The various members that are common with the variant embodiment shown in the preceding figures remain identical. In this variant embodiment the instrument 1 comprises a fixed box 2 and a moving box 3 moving about a hinge axis 6. The air supply 17 is constituted by at least one, and in the example shown two, individual chambers 19, each arranged in a box and communicating with inlets and escape holes 28 made in the base of the instrument. Each individual chamber 19 is fitted with a moving air compression member 18 such as a piston or a disk that moves linearly inside the chamber 19 that is implemented in the form of a cylinder, movement being driven by a transmission that converts the pivoting motion of the moving box into linear motion. It should be observed that the left-hand portion of FIG. 11 shows air flow when suction is created in the supply 17, whereas the right-hand portion of FIG. 11 shows air flow when compression is created in the supply 17.

The individual chambers 19 communicate with one another via a connection circuit 20. Each box 2, 3 includes an enclosure 41 for reversing air flow connected to an individual chamber 19 via a hole 40 and to a duct 42 for admitting air to the cells 26 that is formed in the or each board 25, via an air admission check valve 43. The admission duct 42 fitted with air inlets $\mathbf{42}_1$ communicates via the cells 26 with an air escape duct 44 provided with air outlets 45 and with an air escape check valve 46 to pass communication with the flow reversal enclosure 41. Thus, the flow that engages the reeds 27 always flows past them in the same direction regardless of the direction in which air flows from the supply 17.

In another variant embodiment, the instrument 1 includes sensors suitable for detecting variations in the strength of the outgoing and/or incoming flow of air relative to the supply 17. These anemometer type sensors are connected to conversion and processor circuits for generating all types of sound effect such as the "wha-wha" effect or to trigger, while having a frequency imparted thereto, so-called "delay line" effects (delays, phasing, flangers, . . . ).

The invention is not limited to the elements described and shown since various modifications can be made thereto without going beyond the ambit of the invention.

The invention claimed is:

1. A musical instrument having free reeds set into vibration by a flow of air generated by an air supply (17) and capable of flowing from the supply in two directions referred to respectively as in and out, the instrument comprising:

at least two boxes (2, 3) that are movable relative to each other by moving towards each other or apart from each other;

a series of free reeds (27) mounted inside said boxes; and a valve actuator mechanism (31), where opening and closing the valves enables the reeds to be engaged or not engaged by the flow of air, the mechanism including in particular actuator keys (11) mounted on the moving boxes;

the instrument being characterized in that it includes support and guide means (5) for supporting and guiding displacement of the boxes relative to each other along a determined trajectory.

2. An instrument according to claim 1, characterized in that the support and guide means (5) cause the boxes to move relative to each other about at least one pivot axis (6).

3. An instrument according to claim 1, characterized in that the support and guide means (5) cause one of the boxes (3) to move on a fixed box (2).

4. An instrument according to claim 3, characterized in that the moving box (3) is mounted on the fixed box (2) about a pivot axis (6) and as its moving compression member (18) includes arms (21) extending inside individual chambers (19) connected together to form the air supply.

5. An instrument according to claim 1, characterized in that the air supply (17) possesses a fixed capacity within which there moves at least one moving air compression member (18) with displacement thereof being controlled by the moving box (3).

6. An instrument according to claim 5, characterized in that the moving box (3) is mounted on the fixed box (2) about a pivot axis (6) and as its moving compression member (18) includes arms (21) extending inside individual chambers (19) connected together to form the air supply.

7. An instrument according to claim 1, characterized in that it includes means for creating a force opposing the movement of the boxes (2, 3) towards each other and/or for urging the boxes (2, 3) apart from each other while they are moving apart.

8. An instrument according to claim 1, characterized in that it includes means for channeling the air flow that are adapted so that the flow engaging each reed (27) always flows in the same direction, independently of the flow direction from the supply.

9. An instrument according to claim 8, characterized in that the air flow channeling means comprise:

air inlets and air outlets provided in the boxes;

at least one individual chamber (19) provided in at least one of the boxes so as to constitute the air supply (17);

a series of cells (26) each provided with at least one free reed (27) and a valve (31) of the actuator mechanism; and an air flow reversing enclosure (41) connected to an individual chamber (19), and firstly a duct (42) for admitting air to the cells (26) and fitted with an air admission check valve (43), and secondly an air escape duct (44) provided with an air escape check valve (46).

10. An instrument according to claim 9, characterized in that each valve (31) of a cell is caused to move by an electromagnet controlled by a converter for converting light energy into electrical energy, the light energy being conveyed by an optical fiber forming part of the actuator mechanism.

11. An instrument according to claim 9, characterized in that each valve (31) of a cell is constituted by a piezoelectric diaphragm controlled by a converter for converting light energy into electrical energy.

12. An instrument according to claim 9, characterized in that the each box (2, 3) possesses a rounded outer wall (9, 15) in which the escape holes (28) are arranged.

13. An instrument according to claim 8, characterized in that the air flow channeling means comprise:

air inlets (23) fitted with regulator means allowing air admission only towards the supply (17);

air outlets (24) fitted with regulator means allowing air to flow from the supply (17) only towards the free reeds (27); and a series of cells (26) each fitted with at least one free reed (27) and a valve (31) of the actuator mechanism, the cells (26) being fed by the air supply (17) and communicating with escape holes (28).

14. An instrument according to claim 13, characterized in that each valve (31) of a cell is caused to move by an electromagnet controlled by a converter for converting light energy into electrical energy, the light energy being conveyed by an optical fiber forming part of the actuator mechanism.

15. An instrument according to claim 13, characterized in that each valve (31) of a cell is constituted by a piezoelectric diaphragm controlled by a converter for converting light energy into electrical energy.

16. An instrument according to claim 13, characterized in that the each box (2, 3) possesses a rounded outer wall (9, 15) in which the escape holes (28) are arranged.

17. An instrument according to claim 1, characterized in that each reed (27) is fitted with a feeler (33) in permanent contact with the reed, the feeler being constrained in pivoting with a transducer (36) for converting the pivoting movement of the reed into an electrical signal.

18. An instrument according to claim 17, characterized in that the feeler (33) in permanent contact is constrained to turn with an optical type transducer (36).

19. An instrument according to claim 1, characterized in that it includes sensors suitable for detecting variations in the intensity of the air flow leaving and/or entering the supply (17) in order to enable sound effects to be generated.

* * * * *